US005754161A

United States Patent [19]

Noguchi et al.

[11] Patent Number: 5,754,161

[45] Date of Patent: May 19, 1998

[54] GRAPHIC DISPLAY SCROLLING APPARATUS

[75] Inventors: Tadayuki Noguchi; Akihiko Ishimoto; Koji Hirano, all of Hyogo, Japan

[73] Assignees: Mitsubishi Denki Kabushiki Kaisha, Tokyo; Mitsubishi Electric Semiconductor Software Co., Ltd., Hyogo, both of Japan

[21] Appl. No.: 502,728

[22] Filed: Jul. 14, 1995

[30] Foreign Application Priority Data

Jan. 30, 1995 [JP] Japan ..... 7-012720

[51] Int. Cl.[6] ..... G09G 5/34

[52] U.S. Cl. ..... 345/123; 345/121; 345/341

[58] Field of Search ..... 345/123, 124, 345/125, 27, 28, 341, 121; 340/995

[56] References Cited

U.S. PATENT DOCUMENTS

| | | | |
|---|---|---|---|
| 4,611,202 | 9/1986 | DiNitto et al. | 345/123 |
| 5,045,845 | 9/1991 | Yamaoka et al. | 345/28 |
| 5,208,588 | 5/1993 | Nishiyama | 345/123 |

FOREIGN PATENT DOCUMENTS 9213331 8/1992 WIPO .

*Primary Examiner*—Steven Saras
*Assistant Examiner*—Xu-Ming Wu
*Attorney, Agent, or Firm*—McDermott, Will & Emery

[57] ABSTRACT

A graphic scrolling apparatus comprising a unit for storing image data; an image display device having a screen for displaying a first predetermined-sized area of the image data stored in the image data storing unit; a buffer memory for temporarily storing a second predetermined-sized area of the image data stored in the image data storing means, the second predetermined-sized area being larger than the first predetermined-sized area; a first depicting unit for retrieving, from the image storing means, at least image data corresponding to a third area of the first predetermined-sized area, which protrudes from the second predetermined-sized area and for depicting the at least image data corresponding to the third area on a fourth area of the second predetermined sized area, which is in the outside of the first predetermined-sized area as the first predetermined-sized area scrolls on the second predetermined-sized area; and an image display controlling unit for controlling the apparatus such that an image is displayed on the screen of the image display device by changing a reading address for the buffer memory to an address of the fourth area and by reading out data of the first predetermined-sized area based on the changed address at the boundary of the first predetermined-sized area when the first predetermined-sized area protrudes from the second predetermined-sized area as the first predetermined-sized area scrolls on the second predetermined-sized area.

6 Claims, 6 Drawing Sheets

GRAPHIC DISPLAY SCROLLING APPARATUS

BACKGROUND OF THE INVENTION

1. Field of the Invention

This invention relates to a graphic display scrolling apparatus used in, for example, a car navigation system, which performs a graphic scroll smoothly on a screen showing a map, particularly to such a graphic display scrolling apparatus with only a small capacity memory and without a high speed picture drawing processes.

2. Description of the Related Art

A conventional graphic display scrolling apparatus used in, for example, a car navigation system has a frame buffer memory including the display data area AD1 consisting of 9 screen data areas, having the length of 3 screen data areas in both horizontal and vertical directions as shown in FIG. 5 in order to perform a smooth scroll. When a scroll of the display screen DS is performed in a direction along the arrow depicted in the FIG. 5, the display data in the screen display data areas SA8 and SA9 is copied to the screen display data areas SA1 and SA2 after the display screen area DS passes through the screen display data area SA1 and SA2. Next, display data corresponding to areas for renewal on a map below and right to the display data areas SA8 and SA9 is retrieved from a CD-ROM and so forth and the corresponding picture is depicted on the screen display data areas SA4, SA5 and SA6 based on the retrieved data after the display screen DS passes through the screen display data areas SA4, SA5 and SA6. When the display screen DS reaches the bottom of display data area DA1, the display screen DS is switched to the display screen data area SA1. By repeating the above processes, display screen DS is scrolled continuously. In reality, it should be described that an image is scrolled on a screen. However, in this application, for convenience of explanation, a description is used that a display screen is scrolled on the display data area.

Recently, with a smaller size and a lower cost of a navigation system, it is desired that the capacity of the frame buffer memory should be smaller.

FIG. 6 is a drawing which shows scrolling of a display screen DS on the display data area DA4 consisting of 4 screen areas. In this case, a smooth scroll cannot be obtained by the scrolling explained above for display data area DA1 consisting of 9 screen areas. The reason why a smooth scroll cannot be obtained is as follows. An image of the screen display data area SA1 is displayed on the display screen DS immediately after the display screen DS passes through the screen display data areas SA3 and SA4. At the same time, a map picture image corresponding to the area below and right to the screen display data area SA4 must be depicted. Therefore, a scroll is interrupted because an uncompleted picture image is displayed on a display screen unless a picture image processing is speeded up.

FIG. 7 is a block diagram showing a configuration of a frame address generating unit of a conventional graphic display scrolling apparatus which performs the above explained scroll. In this figure, reference numeral 1 denotes a graphic controller, 10 denotes a frame address generating unit, 11 denotes a register circuit for setting parameters such as a display start address and a display data area width, 12 denotes an address adder for adding the display data area width to display address, 13 denotes a latch circuit for latching the added address, 14 denotes a selector for selecting one of the output from the latch circuit 13 and a display start address from the register circuit 11 and for outputting the selected one, 15 denotes a address counter circuit for counting an address outputted from the selector circuit 14, 20 denotes a frame buffer memory for storing graphic image display data supplied from the outside of graphic controller 1.

Firstly, display start address AS and display data area width are inputted to the parameter setting register circuit 11 and data setting is performed. Next, the display start address is selected by the selector 14 and is loaded into the address counter circuit 15, thereby the operation of counting display address of the frame buffer memory 20 is started. After completing the count operation to display address for one line, display start address AS and display data area width DW are added at the address adder 12 during a horizontal sync period. The added data is latched at the latch circuit 13 for the purpose of calculating the display start address of the next line. Then, the added data, i.e., the display start address of the second line is selected by the selector circuit 14 and is loaded in the address counter circuit 15, thereby the operation of counting display address of the second line of the frame buffer memory 20 is started.

Similarly, an increment operation to the display start address of each line, which is loaded into the address counter circuit 15 is repeated. After completing the count operation to the display address for one screen, the display start address AS is selected by the selector 14 and is loaded in the address counter 15.

As explained above, screen display is performed by accessing the addresses of the frame buffer memory 20. Namely, screen scroll within the display data area DA2 is performed by changing the value of the display start address AS for the first line, which is set in the parameter setting register circuit 11. However, if the area for the display screen DS includes a part of the boundary of the display data area DA2, an image displayed on the screen DS is not correct one. Thus, it is necessary for the display screen DS to be within the display data area DA2.

Therefore, when the capacity of the frame buffer memory is small, a halfway depicted image is displayed on the display screen DS at the time of changing display address unless the speed of re-depicting processing is made much higher. This prevents the apparatus from scrolling smoothly because the display screen is interrupted, which is caused by a display of a half depicted image.

SUMMARY OF THE INVENTION

This invention has been made to eliminate the above drawbacks of the conventional apparatus. Accordingly, the object of the invention is to provide a graphic display scrolling apparatus which may perform a smooth scroll even if the capacity of the frame buffer memory is small.

A graphic scrolling apparatus of this invention comprises means for storing image data; an image display device having a screen for displaying a first predetermined-sized area of the image data stored in the image data storing means; a buffer memory for temporarily storing a second predetermined-sized area of the image data stored in the image data storing means, the second predetermined-sized area being larger than the first predetermined-sized area; a first depicting means for retrieving, from the image storing means, at least image data corresponding to a third area of the first predetermined-sized area, which protrudes from the second predetermined-sized area and for depicting the at least image data corresponding to the third area on a fourth area of the second predetermined sized area, which is in the outside of the first predetermined-sized area as the first predetermined-sized area scrolls on the second predetermined-sized area; and image display controlling means for controlling the apparatus such that an image is displayed on the screen of the image display device by changing a reading address for the buffer memory to an address of the fourth area and by reading out data of the first predetermined-sized area based on the changed address at the boundary of the first predetermined-sized area when the first predetermined-sized area protrudes from the second predetermined-sized area as the first predetermined-sized area scrolls on the second predetermined-sized area. Therefore, a smooth scroll on a screen is realized even if the apparatus has a small capacity of a buffer memory.

The above graphic scrolling apparatus can be structured such that the first depicting means depicts a horizontally protruding area of the third area, a vertically protruding area of the third area and a diagonally protruding area of the third area on a first part of the second predetermined-sized area in the horizontal direction, a second part of the second predetermined-sized area in the vertical direction and a third part of the second predetermined-sized area in the diagonal direction, respectively after retrieving the corresponding image data from the image storing means. Due to this structure, an effective usage of buffer memory is possible even if the capacity of the memory is small.

The above graphic scrolling apparatus can be structured such that the image display controlling means includes a first timing generating circuit for generating address changing timing when a reading address reaches the vertical boundary of the second predetermined-sized area during an operation of reading data in the first predetermined-sized area; a second timing generating circuit for generating address changing timing when a reading address reaches the horizontal boundary of the second predetermined-sized area during an operation of reading data in the first predetermined-sized area; a first address generating circuit for generating an address to be read next when a reading address reaches the vertical boundary of the second predetermined-sized area during an operation of reading data in the first predetermined-sized area; a second address generating circuit for generating an address to be read next when a reading address reaches the horizontal boundary of the second predetermined-sized area during an operation of reading data in the first predetermined-sized area; a selecting circuit for selecting and outputting one among addresses generated by the first address generating circuit and the second address generating circuit based on timing generated by the first timing generating circuit and the second timing generating circuit; and an address counter circuit which inputs an address outputted from the selecting circuit and performs a reading address count operations for the first predetermined-sized area, which is superimposed on the second predetermined-sized area, the first part of the second predetermined-sized area, the second part of the second predetermined-sized area and the third part of the second predetermined-sized area, sequentially. Due to this structure, a read operation is made to the first part, the second part and the third part which are stored effectively in terms of memory size.

The above graphic scrolling apparatus can be structured such that the second predetermined-sized area is divided into a plurality of sub-areas each of which is the same size as the first predetermined-sized area and that the graphic scrolling apparatus further includes a second depicting means for performing a depiction operation to sub-areas which are not superimposed on the first predetermined-sized area when the third area exceeds a predetermined value. Due to this structure, a smooth scroll is obtained even if continuous scroll is performed.

DETAILED DESCRIPTION OF THE PREFERRED EMBODIMENTS

The preferred embodiments of the invention will be explained in detail with reference to the drawings.

Figure 1:
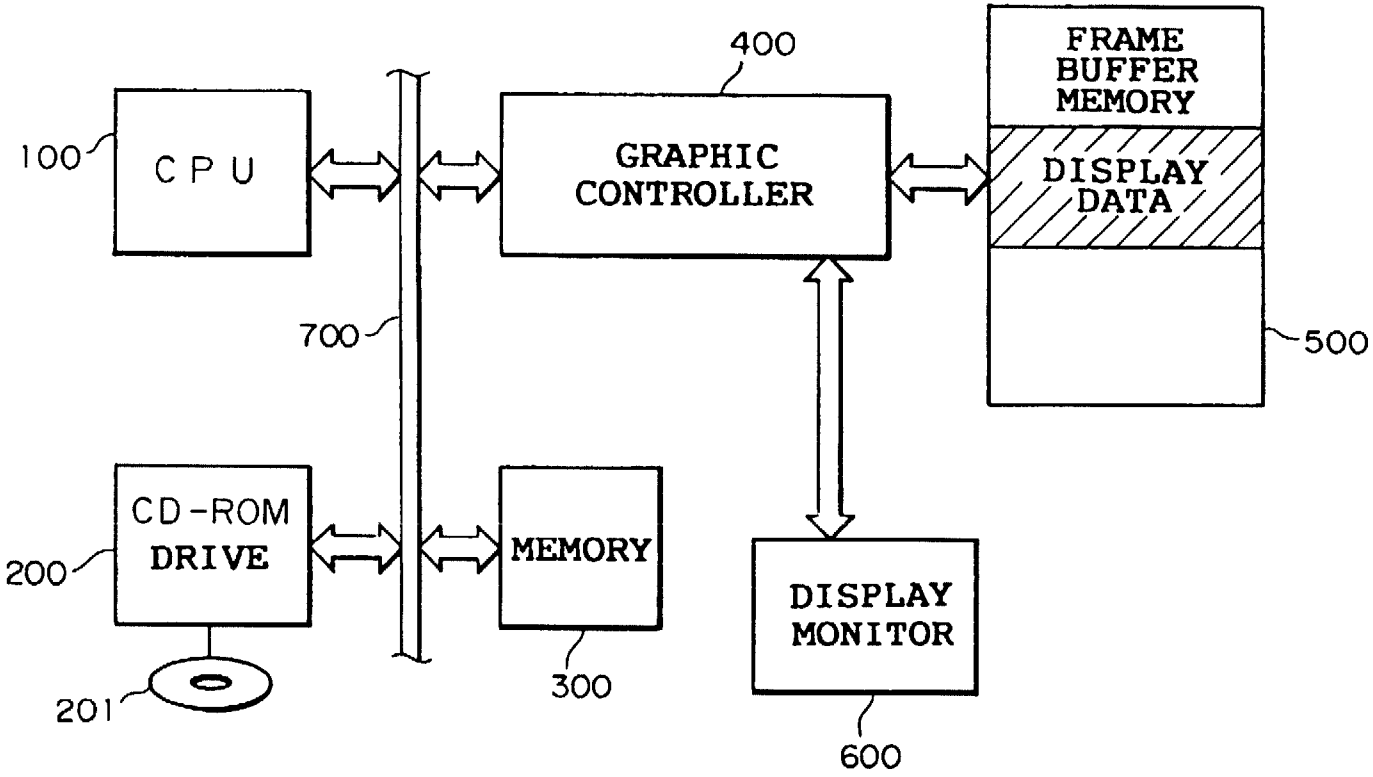
FIG. 1 is a block diagram showing a whole configuration of the apparatus in the embodiment where a graphic display scrolling apparatus of this invention is applied to the navigation system.

FIG. 1 is a block diagram showing a whole configuration of the apparatus in the embodiment where a graphic display scrolling apparatus of this invention is applied to the navigation system. In this figure, reference numeral 100 denotes a CPU (second depicting means) for controlling a whole system operations, 200 denotes a CD-ROM drive which performs a read operation to CD-ROM 201 in which map information is stored in the form of packed pixel and so forth, 300 denotes a memory used as working area for the CPU 100, 400 denotes a graphic controller (first depicting means, image display controlling means) which performs scrolling and graphic image depicting based on data sent from the CD-ROM drive 200, 500 denotes a frame buffer memory which stores display data for displaying image as much as four display screens, 600 denotes a display monitor which displays a graphic image on a screen of the display monitor based on the display data stored in the frame buffer memory 500 under the control of the graphic controller 400, 700 denotes a data bus connecting the CPU 100, CD-ROM drive 200, the memory 300 and the graphic controller 400 so that data can be transferred between them.

Next, the general operation of the above explained navigation system will be explained. At first, a part of the information stored in the CD-ROM 201 is transferred to the memory 300 under the control of the CPU 100. A depicting processing is performed to a part of the image data stored in the memory 300 by a software program run by the CPU 100 and the resultant processed data is stored at a certain address of the frame buffer memory 500. A depicting processing is performed to another part of the image data stored in the memory 300 by a hardware unit of the graphic controller 400 and the resultant processed data is stored at a certain address of the frame buffer memory 500. The display data written in the frame buffer memory 500 is sequentially transferred to the display monitor 600 in response to the scrolling processing of the graphic controller 400, thereby a graphic image is displayed.

Figure 2:
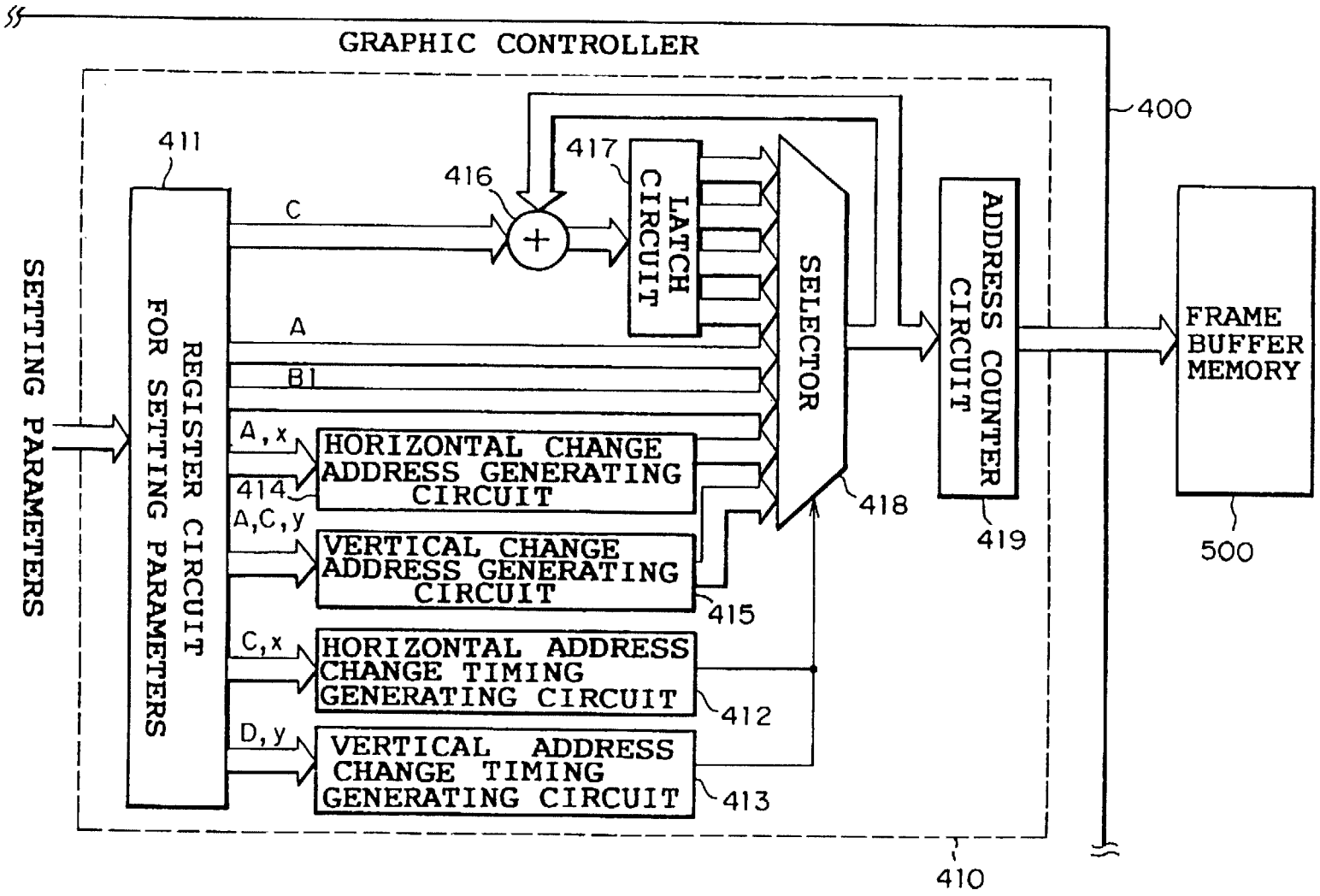
FIG. 2 is a block diagram showing a configuration of the graphic scroll unit of the graphic controller of the embodiment shown in FIG. 1.

Next, a scrolling processing which is a characteristic portion of this invention will be explained. FIG. 2 is a block diagram showing a configuration of the graphic scroll unit 410 of the graphic controller 400. In this figure, reference numeral 411 denotes a register circuit for setting parameters necessary to perform graphic depiction and scroll, 412 denotes a horizontal address change timing generating circuit (first timing generating circuit) which generates timing for changing address at the boundary of display data area in the horizontal direction when display screen protrudes from within the display data area consisting of four screen display areas, 413 denotes a vertical address change timing generating circuit (second timing generating circuit) which generates timing for changing address at the boundary of the display area in the vertical direction when display screen protrudes from within the display data area, 414 denotes a horizontal change address generating circuit (first address generating circuit) which calculates out an address of an image to be actually displayed on the timing controlled by the horizontal address change timing generating circuit 412, 415 denotes a vertical change address generating circuit (second address generating circuit) which calculates out an address of an image to be actually displayed on the timing controlled by the vertical address change timing generating circuit 413, 416 denotes an address adder which produces a start address of each line by adding the display data area width of the frame memory area to the start address of the previous line, 417 denotes a latch circuit for latching data of display start address of each line outputted from the address adder 416, 418 denotes a selector which selects one among outputs from the register circuit 411 for setting parameters, the horizontal change address generating circuit 414, the vertical change address generating circuit 415 and the latch circuit 417 based on the timings generated by the horizontal address change timing generating circuit 412 and the vertical address change timing generating circuit 413, 419 denotes a address counter circuit which outputs addresses for sequentially reading display data on the frame buffer memory 500 from the display start address.

Figure 3:
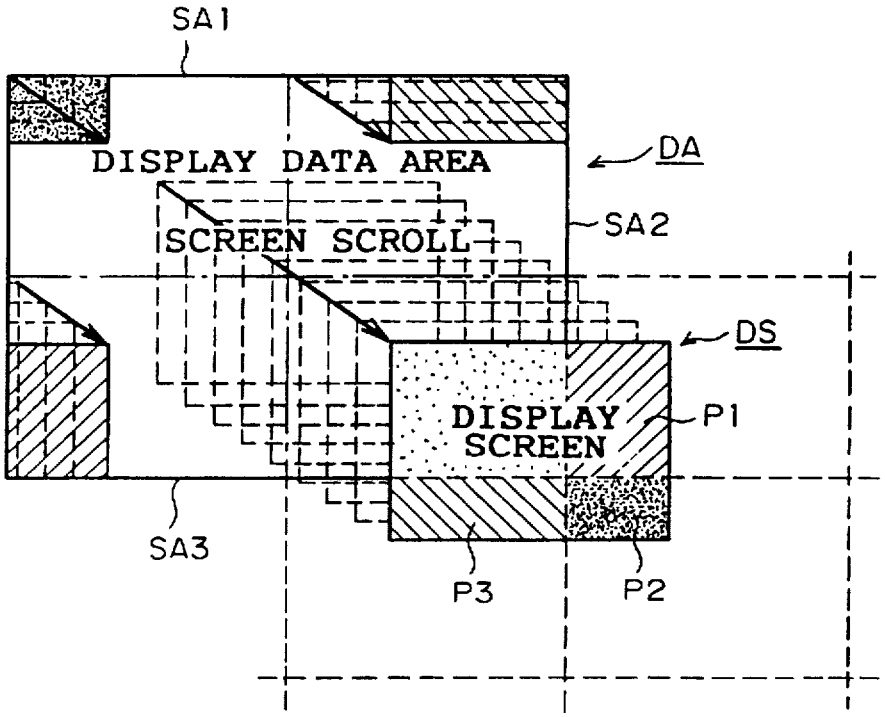
FIG. 3 is a drawing explaining the scrolling of the display screen on the display data area consisting of four screen display data areas, which is stored in the frame buffer memory in the embodiment of this invention.

Next, a scroll operation of this embodiment will be explained. FIG. 3 is a drawing explaining the scrolling of the display screen on the display data area consisting of four screen display data areas, which is stored in the frame buffer memory 500.

As depicted in FIG. 3, as the display screen DS (first area) is scrolled on the display data area DA (second area), the navigation system of this invention depicts in advance with a software program run by the CPU 100 the image portions P1, P2 and P3 which are expected to protrude from within the display data area DA if the present scroll operation continues. An image for the portion P1 is depicted at left lower corner of the screen display data area SA3 of the display data area DA. An image for the portion P2 is depicted at the left upper corner of the screen display data area SA1 of the display data area DA. An image for the portion P3 is depicted at the right upper corner of the screen display data area SA2 of the display data area DA. In the above explanation, the images for the portions P1, P2 and P3 which are expected to protrude from within the display data area DA are depicted in advance with a software program, however, images only for the portion of the display screen DS, which has actually protruded may be depicted sequentially at the three corners.

Next, an explanation will be made to how the image is displayed on the display monitor 600 when the display screen DS is scrolled. In FIG. 3, when the display screen DS exists within the display data area DA, accesses to the frame buffer memory 500 are made in the same manner as that of the conventional graphic display scrolling apparatus and the corresponding readout data is supplied to the display monitor 600 under the control of graphic controller 400, thereby a graphic image is displayed on the screen of the display monitor 600.

Figure 4:
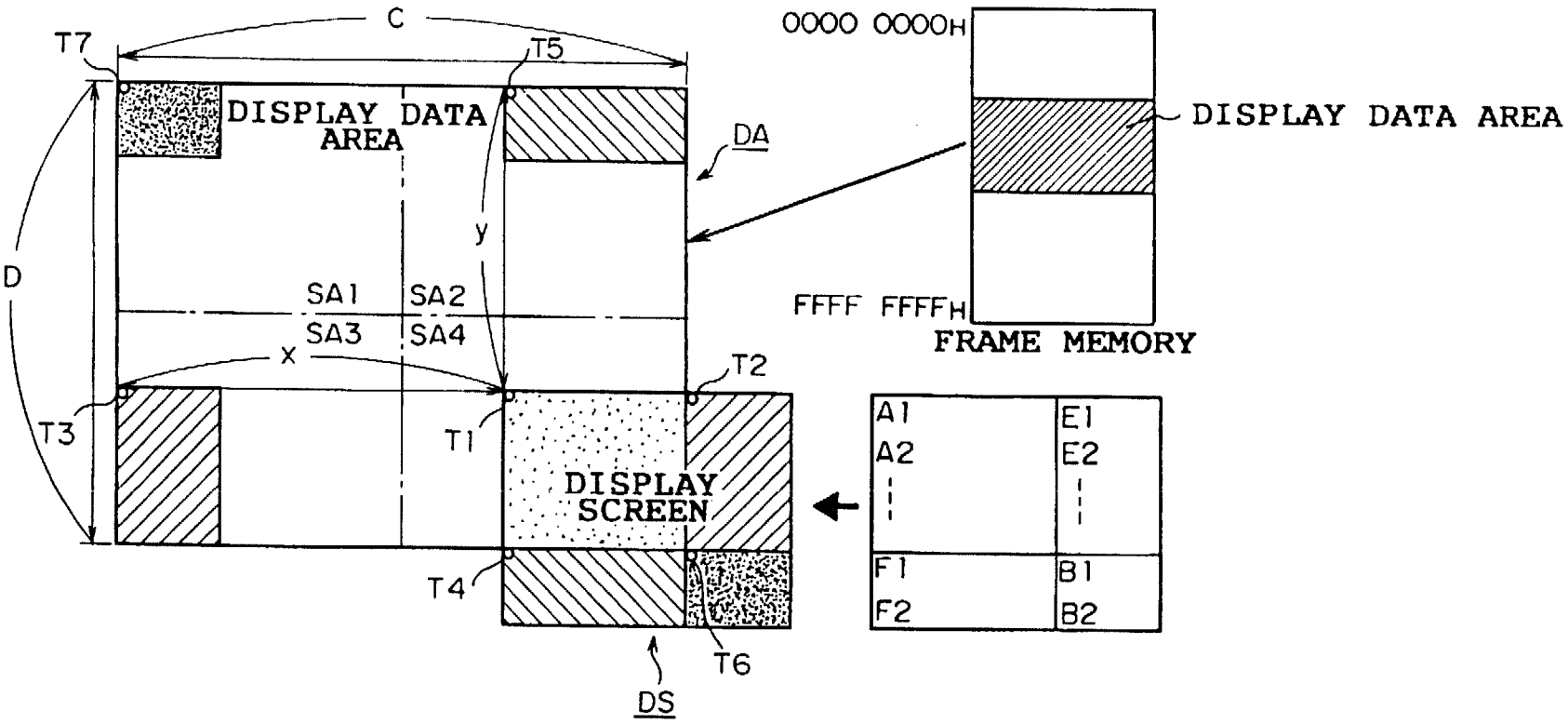
FIG. 4 is a drawing which shows the relationship between the display screen and addresses of buffer memory in the situation where the display screen protrudes beyond the boundary of the display data area during scrolling in the embodiment of this invention.
Figure 5:
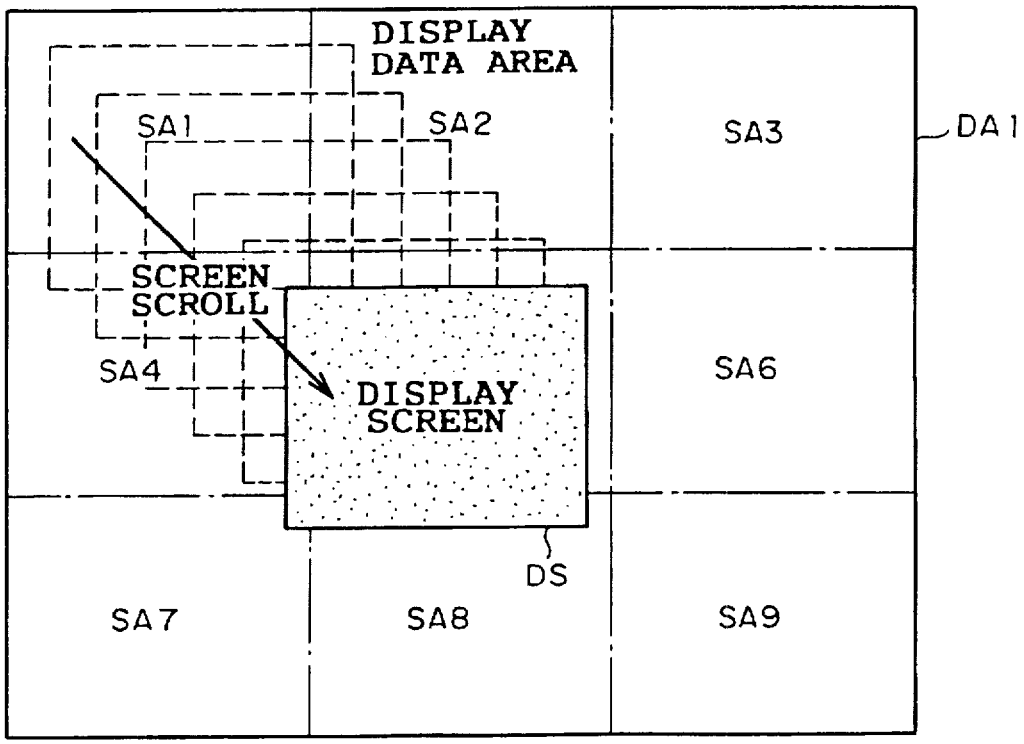
FIG. 5 (PRIOR ART)
FIG. 5 is a drawing which shows scrolling of a display screen DS on the display data area DA4 consisting of 9 screen areas in a conventional graphic scrolling apparatus.
Figure 6:
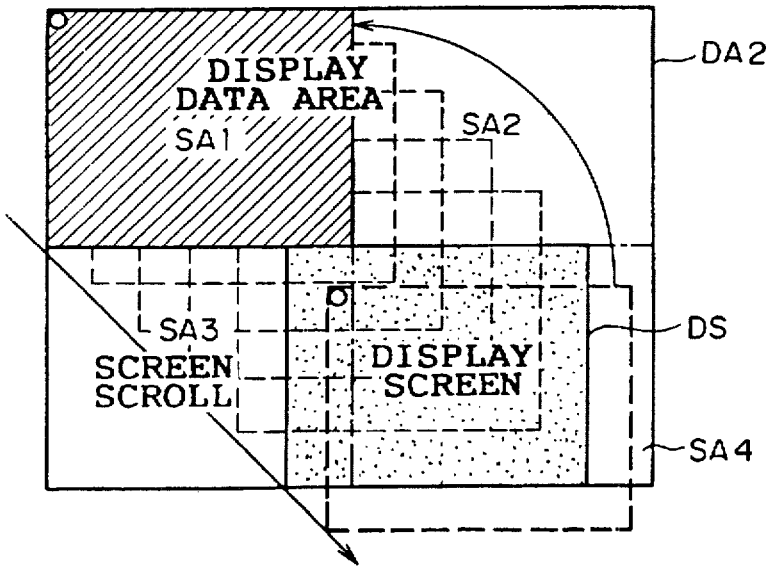
FIG. 6 (PRIOR ART)
FIG. 6 is a drawing which shows scrolling of a display screen DS on the display data area DA4 consisting of 4 screen areas in a conventional graphic scrolling apparatus.
Figure 7:
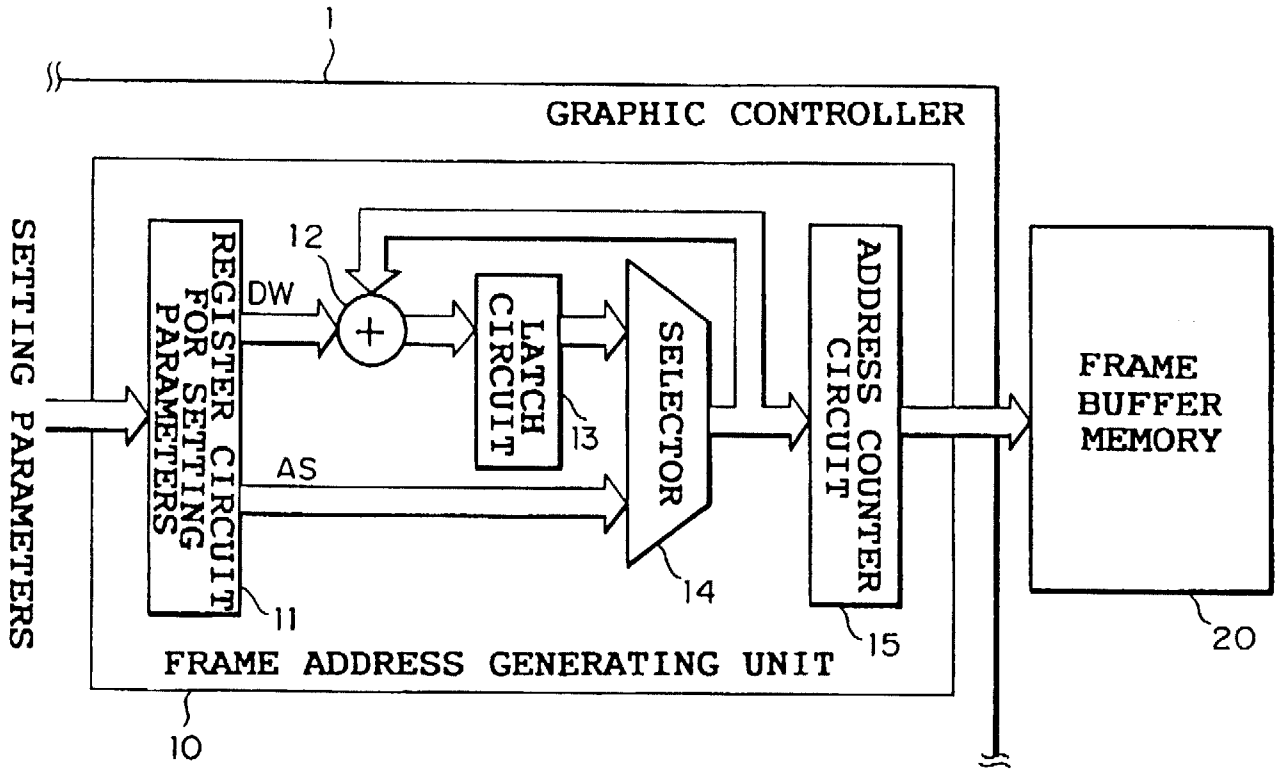
FIG. 7 (PRIOR ART)
FIG. 7 is a block diagram showing a configuration of a frame address generating unit of a conventional graphic display scrolling apparatus.

FIG. 4 is a drawing which shows the relationship between the display screen and addresses of buffer memory in the situation where the display screen protrudes beyond the boundary of the display data area during scrolling. Next, as shown in FIG. 4, an explanation will be made as to how the image is displayed on the display monitor 600 when the display screen DS protrudes beyond the boundary of the display data area DA.

Now, assume that the display screen DS has reached the position as depicted in FIG. 4. The display start address of the register circuit 411 of the graphic depiction and scroll unit 410 is set to the address A1 of the point T1. Then, data of the display data area DA is sequentially accessed in the horizontal direction from the address A1 thereby the corresponding image is displayed on the display monitor 600. When the display operation reaches the point T2 which is on the boundary of the display data area DA, the horizontal address change timing generating circuit 412 generates an address change timing signal. The horizontal change address generating circuit 414 generates the address of the point T3 by executing the following calculation. The address of the point T3 is selected by the selector 418 based on an address change timing signal outputted by the horizontal address change timing generating circuit 412 and the address of the point T3 is loaded into the address counter circuit 419, thereby the present address is changed to the address of the point T3. The horizontal change address generating circuit 414 generates the address to be changed by the calculation (A1−x) where x indicates horizontal change offset value. The horizontal address change timing generating circuit 412 generates an address change timing signal after (C−x) pixels have been counted where C indicates the width of the display data area. After pixels for 1 line have been counted, the address is changed to the start address of the next line of the display screen DS.

The address An, En of the line n are produced based on the following calculations, using the addresses A1, E1 shown in FIG. 4.

$$An=A1+C(n-1)$$

$$En=E1+C(n-1),\ n=2,\ 3,\ \ldots$$

Namely, the addresses An and En (n=2, 3, . . . ) are sequentially loaded into the address counter circuit 419 based on the address change timing signals outputted by the horizontal change timing generating circuit 414, thereby the count operation to the display address is executed. Then, the data on the frame buffer memory 500 according to the addresses outputted from the address counter circuit 419 is sequentially displayed on the display monitor 600.

When the display operation reaches the point T4 on the boundary of the display data area DA, the vertical address change timing generating circuit 413 generates an address change timing signal. The vertical change address generating circuit 415 generates the address F1 of the point T5 by the following calculations. The address of the point T5 is selected by the selector 418 based on address change timing signals outputted from the vertical address change timing generating circuit 413 and is loaded into the address counter circuit 419, thereby the present address is changed to the address of the point T5. The vertical change address generating circuit 415 generates the address to be changed by the calculation (B1+x) where x indicates a horizontal change offset value and B1 indicates the head address of the display data area DA. The vertical address change timing generating circuit 413 generates an address change timing signal after (D−y) lines have been counted where D indicates the length of the display data area and y indicates a vertical change offset value.

When the display operation reaches the point T6 on the right lower corner of the boundary of the display data area DA, the head address B1 of the display data area DA set in the register circuit 411 is selected by the selector 418 and is loaded into the address counter circuit 419, thereby the data access is performed from the address B1 of the point T7. This address change is performed when the horizontal address change timing generating circuit 412 counts (C−x) pixels after the vertical address change timing generating circuit 413 has counted (D−y) lines.

The address Fn, Bn of the line n are produced based on the following calculations, using the addresses F1, B1 shown in FIG. 4.

$$Fn=F1+C(n-1)$$

$$Bn=B1+C(n-1),\ n=2, 3, \ldots$$

Namely, the addresses Fn and Bn (n=2, 3, . . . ) are sequentially loaded into the address counter circuit 419 based on the address change timing signals outputted by the horizontal change timing generating circuit 414, thereby the count operation to the display address is executed. Then, the data on the frame buffer memory 500 according to the addresses outputted from the address counter circuit 419 is sequentially displayed on the display monitor 600.

When the area of the display screen DS which protrudes from the display data area DA exceeds a certain value (e.g., three quarters of the area of the display screen DS), depiction processings are performed to the screen display data areas which is not superimposed on the display screen DS. In the example of the FIG. 4, depiction processings are performed to the screen display areas SA1 to SA3. These depiction processings are performed by a software program or a hardware unit in concurrence with the operation of displaying an image on the screen of the display monitor 600. When the display start address of the display screen DS reaches the boundary of the display data area DA, the display start address of the display screen is changed to one of the address of the left upper corners of the screen display data areas SA1 to SA3. For example, when a scroll is performed again from the left upper corner of the screen display data area SA1, display start address is set to B1 and the offset values x and y are set to "0" in the register circuit 411. The above-explained scroll by which the display screen protrudes beyond the boundary of the display data area DA is named as spherical scroll in this application.

Therefore, a smooth scroll can be performed only with small capacity of the frame buffer memory while renewing the display start address of the display screen DS, offset values x, y as the parameters of the parameter setting register circuit 411.

What is claimed is:

1. A graphic scrolling apparatus, comprising:

means for storing image data;

an image display device having a screen for displaying a first predetermined-sized area of the image data stored in the image data storing means;

a buffer memory for temporarily storing a second predetermined-sized area of the image data stored in the image data storing means, the second predetermined-sized area being larger than the first predetermined-sized area;

a first depicting means for retrieving, from the image storing means, at least image data corresponding to one of a plurality of third areas of the first predetermined-sized area, which protrudes from the second predetermined-sized area and for depicting the at least image data corresponding to one of the plurality of third areas correspondingly in a respective fourth area of the second predetermined-sized area, which is outside of the first predetermined-sized area as the first predetermined-sized area scrolls on the second predetermined-sized area; and image display controlling means for controlling the apparatus such that an image is displayed on the screen of the image display device by changing a reading address for the buffer memory to an address of the fourth area and by reading out data of the first predetermined-sized area based on the changed address at the boundary of the first predetermined-sized area when the first predetermined-sized area protrudes from the second predetermined-sized area as the first predetermined-sized area scrolls on the second predetermined-sized area.

2. A graphic scrolling apparatus according to claim 1, wherein the first depicting means depicts a horizontally protruding area of the third area, a vertically protruding area of the third area and a diagonally protruding area of the third area on a first part of the second predetermined-sized area in the horizontal direction, a second part of the second predetermined-sized area in the vertical direction and a third part of the second predetermined-sized area in the diagonal direction, respectively after retrieving the corresponding image data from the image storing means.

3. A graphic scrolling apparatus according to claim 2, wherein the image display controlling means includes a first timing generating circuit for generating address changing timing when a reading address reaches the vertical boundary of the second predetermined-sized area during an operation of reading data in the first predetermined-sized area; a second timing generating circuit for generating address changing timing when a reading address reaches the horizontal boundary of the second predetermined-sized area during an operation of reading data in the first predetermined-sized area; a first address generating circuit for generating an address to be read next when a reading address reaches the vertical boundary of the second predetermined-sized area during an operation of reading data in the first predetermined-sized area; a second address generating circuit for generating an address to be read next when a reading address reaches the horizontal boundary of the second predetermined-sized area during an operation of reading data in the first predetermined-sized area; a selecting circuit for selecting and outputting one among addresses generated by the first address generating circuit and the second address generating circuit based on timing generated by the first timing generating circuit and the second timing generating circuit; and an address counter circuit which inputs an address outputted from the selecting circuit and performs a reading address count operations for the first predetermined-sized area, which is superimposed on the second predetermined-sized area, the first part of the second predetermined-sized area, the second part of the second predetermined-sized area and the third part of the second predetermined-sized area, sequentially.

4. A graphic scrolling apparatus according to claim 2, wherein the second predetermined-sized area is divided into a plurality of sub-areas each of which is the same size as the first predetermined-sized area and wherein the graphic scrolling apparatus further includes a second depicting means for performing a depiction operation to sub-areas which are not superimposed on the first predetermined-sized area when the third area exceeds a predetermined value.

5. A graphic scrolling apparatus according to claim 3,. wherein the second predetermined-sized area is divided into a plurality of sub-areas each of which is the same size as the first predetermined-sized area and wherein the graphic scrolling apparatus further includes a second depicting means for performing a depiction operation to sub-areas which are not superimposed on the first predetermined-sized area when the third area exceeds a predetermined value.

6. A graphic scrolling apparatus, comprising:

means for storing image data;

an image display device having a screen for displaying a first predetermined-sized area of the image data stored in the image data storing means;

a buffer memory for temporarily storing a second predetermined-sized area of the image data stored in the image data storing means, the second predetermined-sized area being larger than the first predetermined-sized area and divided into a plurality of sub-areas each of which is the same size as the first predetermined-sized area; and depicting means for performing a depiction operation of regions on to corresponding sub-areas of the second predetermined-sized area, wherein each region is provided in a different sub-area of the second predetermined-sized area; and wherein each region is provided in a sub-area different from the sub-area which provides the majority of image data to be displayed in the first predetermined-size area.

* * * * *